US011378363B2

(12) United States Patent
McNelis et al.

(10) Patent No.: US 11,378,363 B2
(45) Date of Patent: Jul. 5, 2022

(54) CONTOURED LINER FOR A RECTANGULAR SLOTTED SHAPED CHARGE

(71) Applicant: DynaEnergetics Europe GmbH, Troisdorf (DE)

(72) Inventors: Liam McNelis, Bonn (DE); Arash Shahinpour, Troisdorf (DE); Joerg Mueller, Bonn-Lengsdorf (DE); Joern Olaf Loehken, Troisdorf (DE)

(73) Assignee: DynaEnergetics Europe GmbH, Troisdorf (DE)

( * ) Notice: Subject to any disclaimer, the term of this patent is extended or adjusted under 35 U.S.C. 154(b) by 0 days.

(21) Appl. No.: 16/973,672

(22) PCT Filed: May 28, 2019

(86) PCT No.: PCT/EP2019/063773
§ 371 (c)(1),
(2) Date: Dec. 9, 2020

(87) PCT Pub. No.: WO2019/238410
PCT Pub. Date: Dec. 19, 2019

(65) Prior Publication Data

US 2021/0254938 A1 Aug. 19, 2021

Related U.S. Application Data

(60) Provisional application No. 62/683,474, filed on Jun. 11, 2018.

(51) Int. Cl.
*F42B 1/028* (2006.01)

(52) U.S. Cl.
CPC ..... *F42B 1/028* (2013.01)

(58) Field of Classification Search
CPC ..... F42B 1/028
(Continued)

(56) References Cited

U.S. PATENT DOCUMENTS 2,667,836 A 2/1954 Church et al.
3,077,834 A 2/1963 Caldwell
(Continued)

FOREIGN PATENT DOCUMENTS

AU 741792 B2 12/2001
CA 2196385 A1 7/1998
(Continued)

OTHER PUBLICATIONS

Dynaenergetics, DMC Boom Times Winter 2016, DynaSlot System Successfully Deployed in a Variety of Applications Around the Globe, Sep. 16, 2016, 3 pgs.
(Continued)

*Primary Examiner* — Samir Abdosh
(74) *Attorney, Agent, or Firm* — Moyles IP, LLC

(57) ABSTRACT

According to the exemplary disclosed embodiments, contoured, curvilinear liners for a rectangular slotted shaped charge are described. The exemplary curvilinear liners include one or more curvilinear contours. The contoured, curvilinear liners provide improved perforating performance for rectangular slotted shaped charges used in oil and gas wellbore operations such as completion and abandonment.

20 Claims, 8 Drawing Sheets

(58) Field of Classification Search
USPC ..... 102/476
See application file for complete search history.

(56) References Cited

U.S. PATENT DOCUMENTS

| | | | | |
|---|---|---|---|---|
| 3,119,178 | A | 1/1964 | Owen et al. | |
| 3,235,005 | A | 2/1966 | Jacques | |
| 3,255,659 | A | 6/1966 | Venghiattis | |
| 3,327,630 | A | 6/1967 | Bell | |
| 3,375,108 | A | 3/1968 | Wyman et al. | |
| 3,589,453 | A | 6/1971 | Venghiattis | |
| 3,675,575 | A | 7/1972 | Bailey et al. | |
| 3,777,663 | A | 12/1973 | Brown | |
| 4,099,464 | A | 7/1978 | Cross et al. | |
| 4,109,576 | A | 8/1978 | Eckels | |
| 4,387,773 | A | 6/1983 | McPhee | |
| 4,496,008 | A | 1/1985 | Pottier et al. | |
| 4,499,830 | A | 2/1985 | Majerus et al. | |
| 4,537,132 | A * | 8/1985 | Sabranski | F42B 1/028 102/307 |
| 4,784,061 | A | 11/1988 | Christopher | |
| 4,817,531 | A | 4/1989 | Walker et al. | |
| 5,155,296 | A | 10/1992 | Michaluk | |
| 5,505,135 | A | 4/1996 | Fritz et al. | |
| 5,509,356 | A * | 4/1996 | Renfro | F42B 1/028 102/307 |
| 5,567,906 | A | 10/1996 | Reese et al. | |
| 5,792,977 | A | 8/1998 | Chawla | |
| 6,098,707 | A | 8/2000 | Pastusek et al. | |
| 6,349,649 | B1 | 2/2002 | Jacoby et al. | |
| 6,378,438 | B1 * | 4/2002 | Lussier | F42B 1/032 102/306 |
| 6,446,558 | B1 | 9/2002 | Peker et al. | |
| 6,453,817 | B1 | 9/2002 | Markel et al. | |
| 6,520,258 | B1 | 2/2003 | Yang et al. | |
| 6,619,176 | B2 | 9/2003 | Renfro et al. | |
| 6,668,726 | B2 * | 12/2003 | Lussier | F42B 1/028 102/307 |
| 6,684,791 | B1 | 2/2004 | Barnhart | |
| 6,925,924 | B2 | 8/2005 | Baker et al. | |
| 7,011,027 | B2 | 3/2006 | Reese et al. | |
| 7,237,486 | B2 | 7/2007 | Myers, Jr. et al. | |
| 7,347,279 | B2 | 3/2008 | Li et al. | |
| 7,690,306 | B1 | 4/2010 | King | |
| 7,721,649 | B2 | 5/2010 | Hetz et al. | |
| 7,775,279 | B2 | 8/2010 | Marya et al. | |
| 7,987,911 | B2 | 8/2011 | Rhodes et al. | |
| 8,156,871 | B2 | 4/2012 | Behrmann et al. | |
| 8,220,394 | B2 | 7/2012 | Bates et al. | |
| 8,322,284 | B2 | 12/2012 | Meddes et al. | |
| 8,342,094 | B2 | 1/2013 | Marya et al. | |
| 8,418,622 | B1 | 4/2013 | Pham et al. | |
| 8,544,563 | B2 | 10/2013 | Bourne et al. | |
| 8,561,683 | B2 | 10/2013 | Wood et al. | |
| 8,584,772 | B2 | 11/2013 | Yang et al. | |
| 8,701,767 | B2 | 4/2014 | Andrzejak et al. | |
| 8,794,153 | B2 | 8/2014 | Glenn | |
| 9,080,432 | B2 | 7/2015 | Yang et al. | |
| 9,187,990 | B2 | 11/2015 | Xu | |
| 9,291,039 | B2 | 3/2016 | King et al. | |
| 9,347,119 | B2 | 5/2016 | Xu | |
| 9,360,222 | B1 * | 6/2016 | Collier | F42C 19/12 |
| 9,612,095 | B2 | 4/2017 | Smart et al. | |
| 9,671,201 | B2 | 6/2017 | Marya et al. | |
| 9,862,027 | B1 | 1/2018 | Loehken | |
| 10,184,327 | B2 | 1/2019 | Skyler | |
| 10,267,127 | B2 | 4/2019 | Geerts et al. | |
| 10,376,955 | B2 | 8/2019 | Loehken | |
| 10,683,735 | B1 | 6/2020 | McCarthy et al. | |
| 10,739,115 | B2 | 8/2020 | Loehken et al. | |
| 10,954,760 | B2 | 3/2021 | Mcnelis et al. | |
| 2001/0052303 | A1 | 12/2001 | Mayseless et al. | |
| 2002/0017214 | A1 | 2/2002 | Jacoby et al. | |
| 2002/0189482 | A1 | 12/2002 | Kneisl et al. | |
| 2005/0011395 | A1 | 1/2005 | Langan et al. | |
| 2005/0115448 | A1 | 6/2005 | Pratt et al. | |
| 2009/0078144 | A1 | 3/2009 | Behrmann et al. | |
| 2009/0151949 | A1 | 6/2009 | Marya et al. | |
| 2011/0094406 | A1 | 4/2011 | Marya et al. | |
| 2011/0155013 | A1 | 6/2011 | Boyer et al. | |
| 2013/0056208 | A1 | 3/2013 | Xu | |
| 2013/0327571 | A1 | 12/2013 | Andrzejak | |
| 2014/0314977 | A1 | 10/2014 | Weinhold | |
| 2015/0316360 | A1 | 11/2015 | Hinton et al. | |
| 2015/0361774 | A1 | 12/2015 | Flores | |
| 2016/0169639 | A1 | 6/2016 | Smart et al. | |
| 2016/0202027 | A1 | 7/2016 | Peterson et al. | |
| 2016/0349021 | A1 | 12/2016 | Collier et al. | |
| 2017/0052004 | A1 * | 2/2017 | Xue | E21B 43/117 |
| 2017/0058648 | A1 | 3/2017 | Geerts et al. | |
| 2018/0087353 | A1 | 3/2018 | Skyler | |
| 2018/0252507 | A1 * | 9/2018 | Collier | F42C 19/0807 |
| 2018/0372460 | A1 | 12/2018 | Loehken et al. | |
| 2020/0217629 | A1 | 7/2020 | Loehken et al. | |
| 2020/0300067 | A1 | 9/2020 | Mcnelis et al. | |
| 2021/0164330 | A1 | 6/2021 | Mcnelis et al. | |

FOREIGN PATENT DOCUMENTS

| | | | | |
|---|---|---|---|---|
| CA | 3048505 | A1 | 7/2018 | |
| CA | 2933762 | C | 4/2020 | |
| CN | 105377479 | A | 3/2016 | |
| CN | 210598934 | U | 5/2020 | |
| CN | 211115936 | U | 7/2020 | |
| DE | 19630339 | A1 | 1/1997 | |
| EP | 0538135 | B1 | 5/1997 | |
| EP | 1345003 | A2 * | 9/2003 | F42B 1/028 |
| EP | 1345003 | A2 | 9/2003 | |
| EP | 1317650 | B1 | 5/2006 | |
| EP | 2598830 | A1 | 6/2013 | |
| EP | 1682846 | B1 | 1/2014 | |
| EP | 3144630 | B1 | 1/2020 | |
| GB | 916870 | A | 1/1963 | |
| GB | 2295664 | A | 6/1996 | |
| WO | 2001096807 | A2 | 12/2001 | |
| WO | 2005035939 | A1 | 4/2005 | |
| WO | 2006054081 | A1 | 5/2006 | |
| WO | 2008102110 | A1 | 8/2008 | |
| WO | 2009117548 | A1 | 9/2009 | |
| WO | 2016161376 | A1 | 10/2016 | |
| WO | 2017029240 | A1 | 2/2017 | |
| WO | 2018234013 | A1 | 12/2018 | |
| WO | 2019105721 | A1 | 6/2019 | |
| WO | 2020150232 | A1 | 7/2020 | |
| WO | 2021123041 | A1 | 6/2021 | |
| WO | 2021198180 | A1 | 10/2021 | |

OTHER PUBLICATIONS

Dynaenergetics, DynaSlot System, 360 Certainty Well Abandonment, 6 pgs., https://www.dynaenergetics.com/uploads/files/55a93e381517b_Product_Brochures_DynaSlot_OnlineView.pdf.

International Search Authority, International Search Report and Written Opinion of PCT Application No. PCT/EP2019/063773, dated Aug. 23, 2019, 16 pgs.

International Bureau; International Preliminary Report on Patentability for PCT Application #PCT/EP2019/063773; dated Dec. 24, 2020; 11 pages.

International Searching Authority; International Search Report and Written Opinion of the International Searching Authority for PCT/EP2021/057148; dated Jul. 29, 2021; 12 pages.

* cited by examiner

CONTOURED LINER FOR A RECTANGULAR SLOTTED SHAPED CHARGE

CROSS-REFERENCE TO RELATED APPLICATIONS

This application is a national phase of and claims priority to Patent Cooperation Treaty (PCT) Application No. PCT/EP2019/063773 filed May 28, 2019, which claims the benefit of United States Provisional Patent Application No. 62/683,474 filed Jun. 11, 2018. The entire contents of each application listed above are incorporated herein by reference.

FIELD

The disclosure relates generally to a slotted shaped charge for use in oilfield and gas well perforating operations. More specifically, the disclosure relates to a contoured, curvilinear liner for a slotted shaped charge.

BACKGROUND

Slotted shaped charges are commercially available and used as part of, for example, perforating gun assemblies in oilfield and gas well completions. The slotted shaped charges are explosive components and are typically arranged in a helical pattern around at least one substantially cylindrical charge carrier in a perforating gun assembly. The charges may be used for various purposes, for example to generate holes in, e.g., steel casing such as piping or tubing, and cement lining a well, to generate flow paths for fluids that may be used to clean and/or seal the well, and to perforate surrounding geological formations to access oil and/or gas deposits within the formations. A slotted shaped charge is usually rectangular and is referred to as "slotted" because the perforations caused by the slotted shaped charge are rectangularly-shaped slots. As such, slotted shaped charges arranged in a helical fashion around a cylindrical charge carrier may be overlapped to provide 360° access to the structures and formations within a wellbore.

A slotted shaped charge typically includes a casing housing an explosive material and a liner enclosing the casing above the explosive material. The charge also includes a detonation initiator, such as a detonating cord, that is configured within the perforating gun assembly to electrically or mechanically initiate an explosion of the explosive material. The explosion collapses the liner above the explosive material and thereby releases a jet of thermal energy and liner particulate from the slotted shaped charge. Thus, the jet provides a focused ballistic energy that may be used to perforate the well casings, geological formations, and other targets in the path of the jet. The slotted shaped charge may be designed with, among other things, a particular size, explosive load, and liner for a particular application. The liner, too, may be designed from particular materials and may have a particular shape depending on the application for the slotted shaped charge. The various design considerations may affect, for example, the jet geometry, perforation geometry, depth of penetration, and other properties of a slotted shaped charge and associated ballistics.

Specifically, the explosion of a rectangular, slotted shaped charge produces ballistic energy that creates a detonation wave that moves toward the open end of the casing that houses the explosive charge. The wave is shaped by the opening to create a linear perforating jet upon initiation which, in turn, creates a rectangular perforation in the target surface. Thus, the jet pierces the casing and/or cement liner and forms a rectangular tunnel in the surrounding target formation. Larger perforating jets create larger perforations in the target formation and increase the potential oil and/or gas flow. The overall size of the liner in the slotted shaped charge may contribute to the size/span of the perforating jet that is formed upon detonation of the slotted shaped charge and provide for a larger perforation in the target formation.

In addition to providing for oil and/or gas flow in the wellbore, another objective of slotted shaped charges is to assist in abandoning wells and/or oilfields. Well abandonment typically involves complicated procedures wherein the wellbore must be shut in and permanently sealed using cement. It is essential that elements of the geo-formation such as layers of sedimentary rock, and in particular freshwater aquifers, are pressure isolated. Unwanted vertical channels or voids in a previously cemented wellbore annulus such as the space between an inner well casing and an outer well casing may produce migration pathways for fluids or gas. Thus, an objective behind perforating with a slotted shaped charge may be to produce a longitudinal slot or linear-shaped slit or hole on the target piping/tubing that is particularly useful in closing/abandonment procedures.

Based on the above considerations, various liners for slotted shaped charges have been developed to, among other things, increase/optimize the size of the perforating jet and perforations in wellbore casings and target formations. However, with ever-evolving economic and environmental considerations in oil and gas completions, liners that further improve the perforating performance of slotted shaped charges are needed to increase the potential oil and/or gas flow in wellbores and effectively close the wellbores for abandonment.

BRIEF DESCRIPTION

According to one aspect of the disclosure, the disclosure relates generally to a contoured, curvilinear liner for use with a slotted shaped charge. An exemplary curvilinear liner may include a first wing and a second wing, wherein each of the first wing and the second wing includes a curvilinear exterior surface that extends from a curvilinear internal central edge to a curvilinear exterior peripheral edge, each of the first wing and the second wing includes a curvilinear interior surface that extends from a curvilinear interior central edge to a curvilinear interior peripheral edge, the first wing and the second wing converge at an apex of the curvilinear exterior central edge, and the curvilinear interior surface is separated from the curvilinear exterior surface by a thickness of the wing; a face surface including a first end and a second end that extends away from and is opposite the first end, wherein the face surface spans between the exterior peripheral edge and the interior peripheral edge; and, a curvilinear bottom edge including a first end and a second end that extends away from and is opposite of the first end, wherein the curvilinear bottom edge is defined by the curvilinear interior central edge. Each of the curvilinear bottom edge, curvilinear exterior central edge, face surface, and first wing and second wing may define a contour of the curvilinear liner. For purposes of this disclosure, "curvilinear" is defined as contained by, or including, at least one curved line and/or a shape contained by or including at least one curved line. "Contour" is defined without limitation as a profile, shape, or the like.

In an exemplary embodiment, one or each of the first wing and the second wing may have a curvilinear contour defined by at least one of the exterior surface or the interior surface of the wing. In the same or different exemplary embodiments, one or each of the first wing and the second wing may be substantially straight.

According to another aspect of the exemplary disclosed embodiments, each of the first wing and the second wing may have a thickness that varies or remains substantially constant.

The disclosure also relates to a shaped charge including a liner according to the exemplary disclosed embodiments, a system including a perforating gun containing at least one shaped charge with a liner according to the exemplary disclosed embodiments, and a method of perforating structures and formations in a wellbore using a perforating gun containing at least one shaped charge having a liner according to the exemplary disclosed embodiments.

BRIEF DESCRIPTION OF THE FIGURES

A more particular description will be rendered by reference to specific embodiments thereof that are illustrated in the appended drawings. Understanding that these drawings depict only typical embodiments thereof and are not therefore to be considered to be limiting of its scope, exemplary embodiments will be described and explained with additional specificity and detail through the use of the accompanying drawings in which.

Figure 1A:
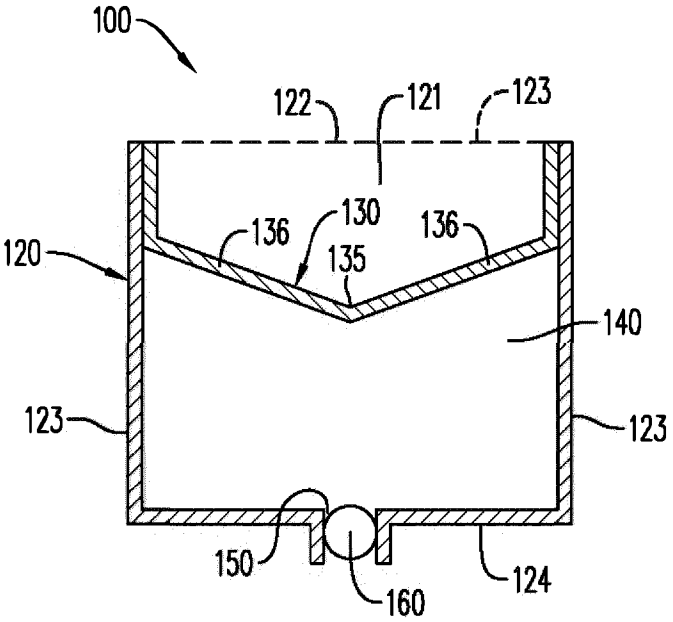
FIG. 1A (PRIOR ART)
FIG. 1A shows a cross-sectional view of a non-axisymmetric shaped charge according to the prior art.

Various features, aspects, and advantages of the embodiments will become more apparent from the following detailed description, along with the accompanying figures in which like numerals represent like components throughout the figures and text. The various described features are not necessarily drawn to scale, but are drawn to emphasize specific features relevant to some embodiments.

The headings used herein are for organizational purposes only and are not meant to limit the scope of the description or the claims. To facilitate understanding, reference numerals have been used, where possible, to designate like elements common to the figures.

DETAILED DESCRIPTION

Reference will now be made in detail to various exemplary embodiments. Each example is provided by way of explanation, and is not meant as a limitation and does not constitute a definition of all possible embodiments.

FIG. 1A illustrates a cross-section of one typical embodiment of a non-axisymmetric shaped charge 100 having a liner 130 with a linear, angular (i.e., "v-shaped") profile, according to the prior art. In the illustrated embodiment, the non-axisymmetric shaped charge 100 is a slotted shaped charge. The non-axisymmetric shaped charge 100 is illustrated having a casing 120 and the liner 130 is housed within the casing 120. According to an aspect, the casing 120 is a non-axisymmetric shaped casing. The casing 120 is shown including two sidewalls 123 (the boundary of a third sidewall 123 is shown by a dashed line and a fourth sidewall is not visible in the cross-sectional view of FIG. 1A), a back wall 124, and an open front portion 122 opposite the back wall 124. The casing 120 includes a hollow interior 121 bounded by the back wall 124 and sidewalls 123 within which the liner 130 is housed. The liner 130 may be arranged within the hollow interior 121 in a manner configured to close the open front portion 122 relative to the back wall 124 at any suitable position within the hollow interior 121 as applications dictate. In the embodiment shown in FIG. 1A, the liner 130 has an apex 135 which is a substantially central portion of the liner 130 positioned below all other portions of the liner 130 in the hollow interior 121. Opposing linear wings 136 extend away from the apex 135. The liner 130 is made of a material selected based on the target to be penetrated, and may be made of powdered metal and/or metal alloys held together by a percentage of binder materials. The powdered metal and/or metal alloy forming the liner 130 may include at least one of copper, tin, tungsten, lead, nickel, bronze, molybdenum or combinations thereof. In some embodiments, the liner 130 may be made of a formed solid metal sheet, rather than compressed powdered metal and/or metal alloys. In another embodiment, the liner 130 may be made of a non-metal material, such as glass, cement, high-density composite or plastic.

With further reference to FIG. 1A, an explosive load 140 may be disposed within the hollow interior 121 and the liner 130 may be positioned to enclose, encase or otherwise cover the explosive load 140 between the liner 130 and the back wall 124. In other words, the explosive load 140 may be enclosed, encased or positioned between the liner 130 and the back wall 124 in such a manner that it is secured within the casing 120. In some embodiments, the liner 130 may be pressed into and/or positioned on or over the explosive load 140. In various embodiments, the liner 130 may extend, e.g., via the wings 136, to the open front portion 122 or any portion of the sidewalls 123 suitable for a particular application of a slotted shaped charge.

Continuing with reference to the typical embodiment of a slotted shaped charge as shown in FIG. 1A, a detonating cord 160 is received by the casing 120 via an aperture or gap 150 in the back wall 124. The detonating cord 160 in the embodiment of FIG. 1A contacts or otherwise abuts or is positioned in a manner to initiate detonation of the explosive load 140 upon firing. The type, configuration, and function of the detonating cord 160 may be according to any known detonating cord techniques consistent with this disclosure.

Figure 1B:
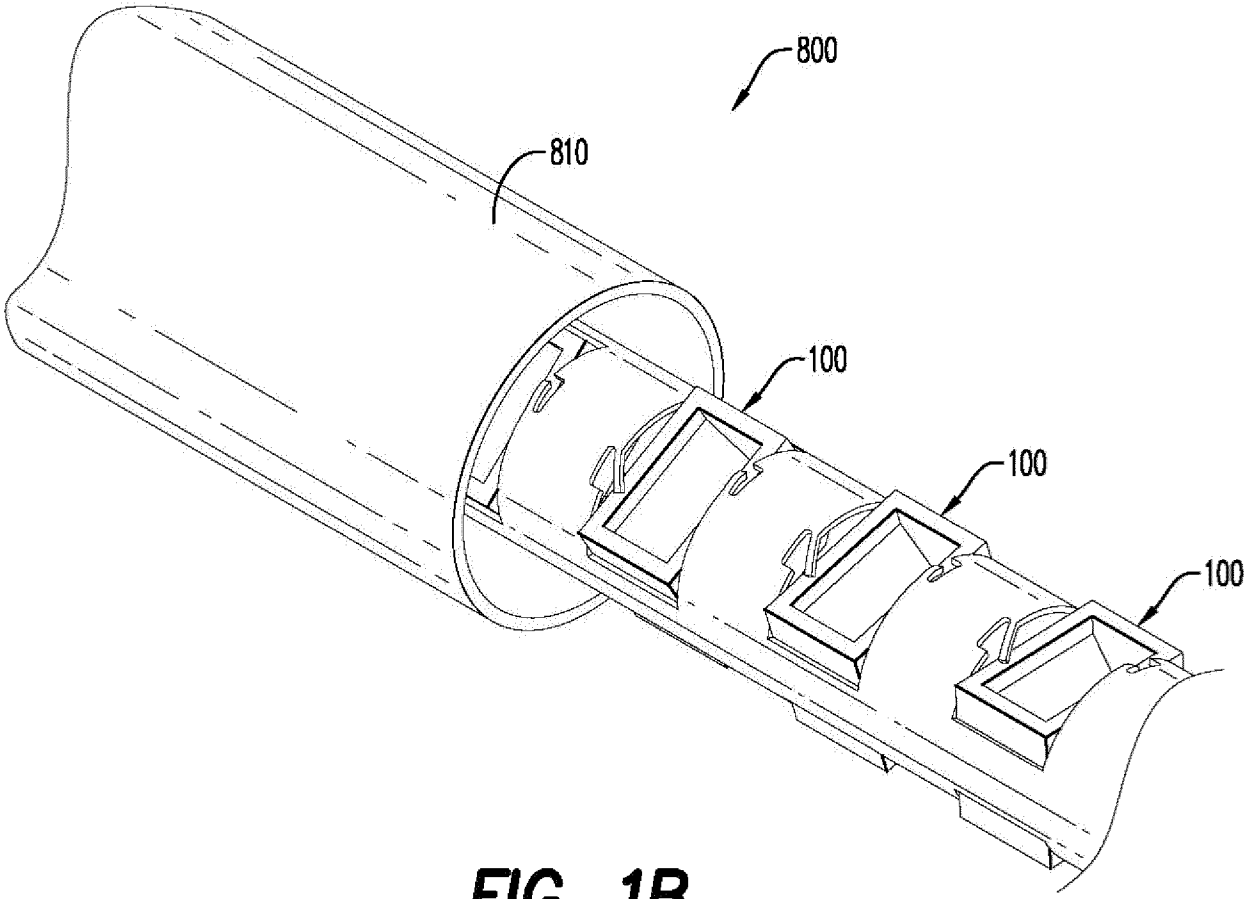
FIG. 1B (PRIOR ART)
FIG. 1B shows a perforating gun containing slotted shaped charges, according to the prior art.

With reference now to FIG. 1B, one or more shaped charges 100 may be used in a perforating gun assembly 800 for downhole perforating operations. Perforating gun 800 includes a carrier tube 810 that houses a charge carrier 820. Shaped charges 100 may be contained by, and arranged in a helical fashion around the charge carrier 820. In operation, the perforating gun 800 may be lowered into a desired position within a wellbore, and the shaped charges 100 initiated at the desired position. The explosive jets that are generated by the shaped charge explosions may then perforate the carrier tube 810, well casings (not shown), cement lining (not shown), and hydrocarbon formations (not shown), for example. A detonating cord (not shown) and other internal components of the perforating gun assembly 800 may also be contained within the charge carrier 820.

Figure 2B:
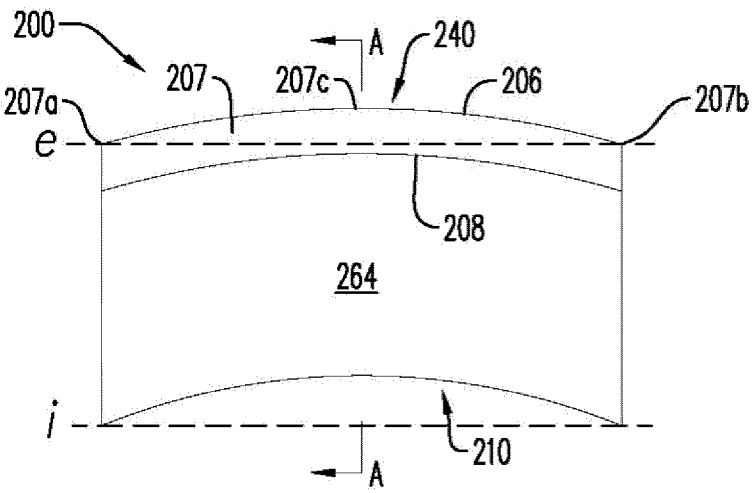
FIG. 2B shows a side plan view of the exemplary trumpet concave contoured liner.
Figure 2A:
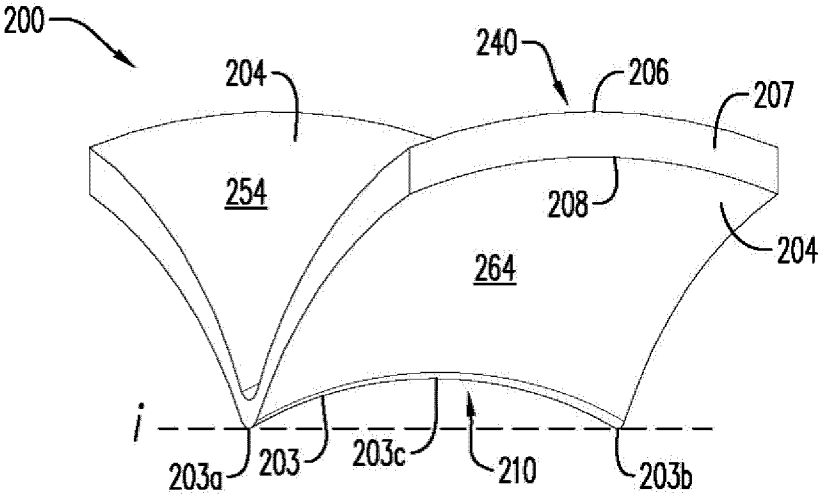
FIG. 2A shows a side perspective view of an exemplary trumpet concave contoured liner.
Figure 2C:
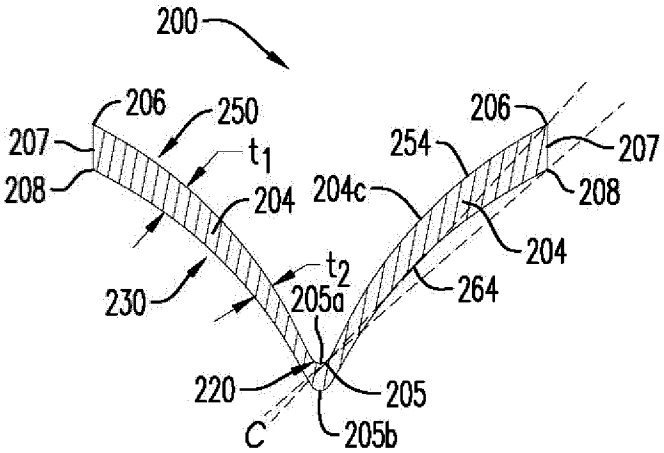
FIG. 2C shows a cross-sectional view of the exemplary trumpet concave contoured liner along a line A-A in FIG. 2B.

With reference now to FIGS. 2A-2C, an exemplary embodiment of a contoured, curvilinear liner 200 for use with a slotted shaped charge according to the disclosure is shown. The exemplary curvilinear liner 200 is configured to be inserted in, e.g., a slotted shaped charge, in a manner such as the liner 130 is inserted in the non-axisymmetric shaped charge 100 shown in FIG. 1A. However, the various disclosed exemplary embodiments of a curvilinear liner 200 (FIGS. 2A-2C), 300 (FIGS. 3A-3C), 400 (FIGS. 4A-4C), 500 (FIGS. 5A-5C), 600 (FIGS. 6A-6C), 700 (FIGS. 7A-7C) may include one or more curvilinear portions that define contours such as 210, 220, 230, 240 (as described below), that define in part an overall contoured, curvilinear shape of the exemplary curvilinear liners.

For example, the exemplary curvilinear liner 200 shown in FIGS. 2A-2C has a "trumpet concave" configuration with at least four contours 210, 220, 230, 240, 250 as explained below. The "trumpet" designation is indicative of the profile shown, for example, in FIG. 2C, wherein an edge contour 250 of a first wing 204 and a second wing 204 arcs outward, resembling the horn of a trumpet. FIG. 2A shows the trumpet concave curvilinear liner 200 from a side perspective view. FIG. 2B is a side plan view of the trumpet concave curvilinear liner 200 and FIG. 2C is a cross-sectional view of the trumpet concave curvilinear liner 200 along a line A-A in FIG. 2B. As shown in those figures, the exemplary trumpet concave curvilinear liner 200 includes, among other things, a curvilinear exterior central edge 205*a*, a curvilinear interior central edge 205*b*, and a curvilinear bottom edge 203 that is defined by the curvilinear interior central edge 205*b*. The first wing 204 and the second wing 204 converge towards an apex 205 of the curvilinear exterior central edge 205*a*. Each of the first wing 204 and the second wing 204 includes a curvilinear exterior surface 254 that extends between the curvilinear exterior central edge 205*a* and a curvilinear exterior peripheral edge 206, and a curvilinear interior surface 264 that extends between the curvilinear interior central edge 205*b* and a curvilinear interior peripheral edge 208. For purposes of this disclosure, the direction generally from the exterior/interior central edge 205*a*/205*b* toward the exterior/interior peripheral edge 206/208 is the "upward" direction. The "downward" direction is opposite the upward direction. Further, for purposes of this disclosure, a first point that is nearer to the exterior/interior peripheral edge 206/208 is "above" a second point that is nearer to the exterior/interior central edge 205*a*/205*b*, and the second point is "below" the first point.

The trumpet concave curvilinear liner 200 and other exemplary disclosed embodiments of a curvilinear liner (300, 400, 500, 600, 700) may be formed, without limitation, from the materials and/or techniques discussed with respect to the liner 130 that is shown in FIG. 1A. In the exemplary embodiment shown in FIGS. 2A and 2C, the first wing 204 and the second wing 204 have a varying thickness $t_1$, $t_2$. In the same or alternative embodiments, one or each of the first wing 204 and the second wing 204 may have a constant thickness. In certain exemplary embodiments, a maximum thickness of the first wing 204 and the second wing 204 may be from approximately 1 millimeter (mm) to approximately 8 mm. In other embodiments, the maximum thickness may be any value required for a particular use and consistent with this disclosure. Further, in the exemplary embodiment shown in FIGS. 2A-2C, the trumpet concave curvilinear liner 200 is symmetrical about at least the curvilinear exterior central edge 205*a* and line A-A in FIG. 2B. In other embodiments, a contoured liner may be symmetrical or asymmetrical about any boundary.

The general aspects of a contoured liner that are discussed above with respect to the trumpet concave curvilinear liner 200 are applicable to other exemplary disclosed embodiments 300, 400, 500, 600, 700 and further embodiments consistent with this disclosure, except where otherwise indicated, and will not be repeated.

Within continuing reference to FIGS. 2A-2C, the trumpet concave curvilinear liner 200 further includes a face surface 207 that spans between the exterior peripheral edge 206 and interior peripheral edge 208 of each of the first wing 204 and the second wing 204. Each of the curvilinear exterior central edge 205*a*, the curvilinear bottom edge 203, the face surface 207 (vis-à-vis the exterior peripheral edge 206 and/or the interior peripheral edge 208), and the curvilinear exterior surface 254 and/or the curvilinear interior surface 264 of each of the first wing 204 and the second wing 204 may define one or more contours 210, 220, 230, 240 of the exemplary trumpet concave curvilinear liner 200. For example, the curvilinear bottom edge 203 defines a bottom edge contour 210 of the trumpet concave curvilinear liner 200. The bottom edge contour 210 is substantially arc-shaped, is bounded by a first end 203*a* of the curvilinear bottom edge 203 and a second end 203*b* of the curvilinear bottom edge 203, and includes an apex 203*c*. The bottom edge contour 210 is concave with respect to a line or plane 'i' that includes the first end 203*a* of the curvilinear bottom edge 203 and the second end 203*b* of the curvilinear bottom edge 203—i.e., the apex 203*c* of the bottom edge contour 210 is above the line i that includes the first end 203*a* and the second end 203*b* of the curvilinear bottom edge 203. Thus, the arc represented by the bottom edge contour 210 extends in an upward direction from each boundary at the first end 203*a* and the second end 203*b* of the curvilinear bottom edge 203 to the apex 203*c*.

With continuing reference to the trumpet concave curvilinear liner 200 shown in FIGS. 2A-2C, the curvilinear exterior central edge 205*a* defines a central edge contour 220. The central edge contour 220 is substantially arc-shaped and may be defined by, or span between, the convergence of the curvilinear exterior surface 254 of the first wing 204 and the curvilinear exterior surface 254 of the second wing 204 at the apex 205 of the curvilinear exterior central edge 205*a*.

The curvilinear exterior surface 254 and/or the curvilinear interior surface 264 of each of the first wing 204 and the second wing 204 may also define a wing contour 230. For example, in the exemplary trumpet concave curvilinear liner 200 shown in FIGS. 2A-2C, the curvilinear exterior surface 254 and the curvilinear interior surface 264 are concave with respect to a corresponding line or plane 'c' that includes the apex 205 of the curvilinear exterior central edge 205*a* and respectively the exterior peripheral edge 206 and the interior peripheral edge 208. In other words, an apex 204*c* of, e.g., the curvilinear exterior surface 254 is above the line c that includes the apex 205 of the curvilinear exterior central edge 205*a* and the exterior peripheral edge 206.

With further reference to FIGS. 2A-2C, the exterior peripheral edge 206 and the interior peripheral edge 208 define a face surface contour 240. The face surface contour 240 may extend between the first end 207*a* of the face surface 207 and the second end 207*b* of the face surface 207. In the exemplary trumpet concave curvilinear liner 200 shown in FIGS. 2A-2C, the face surface contour 240 is concave with respect to a line or plane 'e' that includes each of the first end 207*a* of the face surface 207 and the second end 207*b* of the face surface 207; that is, an apex 207*c* of, e.g., the exterior peripheral edge 206 is above the line e.

Figure 3B:
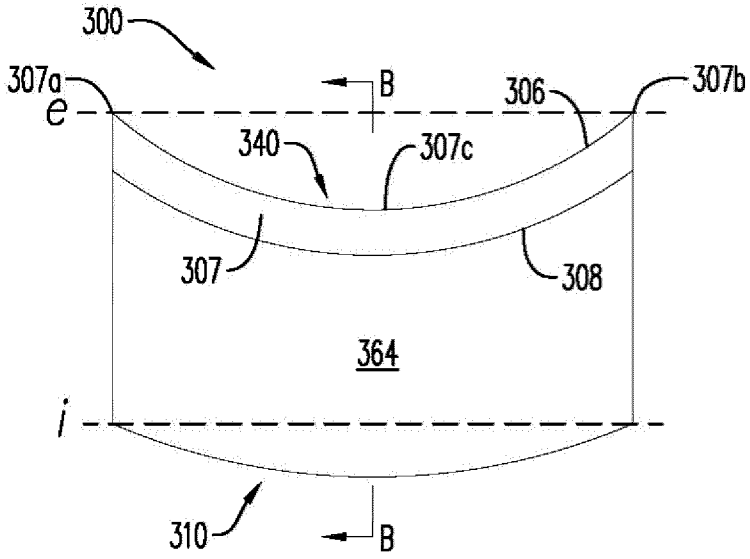
FIG. 3B shows a side plan view of the exemplary trumpet convex contoured liner.
Figure 3A:
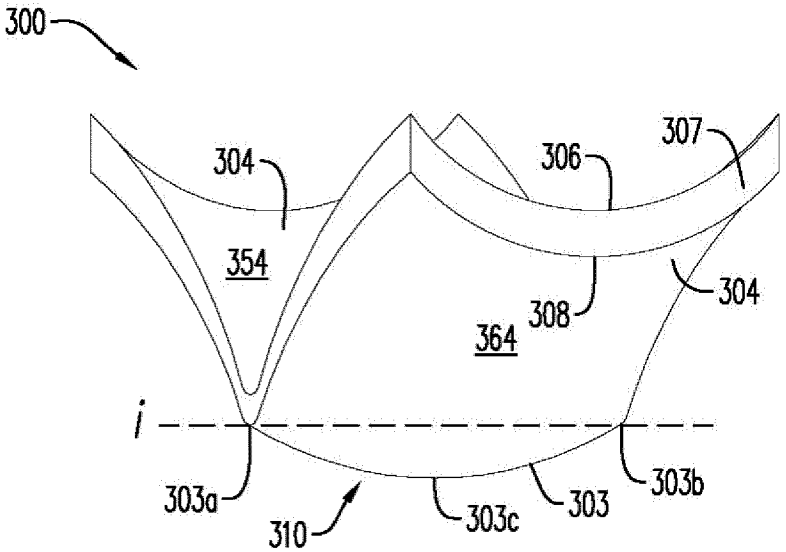
FIG. 3A shows a side perspective view of an exemplary trumpet convex contoured liner.
Figure 3C:
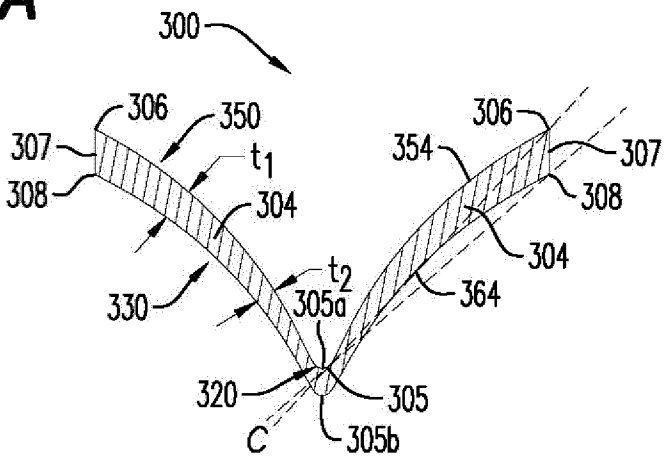
FIG. 3C shows a cross-sectional view of the exemplary trumpet convex contoured liner along a line B-B in FIG. 3B.

With reference now to FIGS. 3A-3C, an exemplary embodiment of a "trumpet convex" curvilinear liner 300 is shown. FIG. 3A shows the trumpet convex curvilinear liner 300 from a side perspective view. FIG. 3B is a side plan view of the trumpet convex curvilinear liner 300 and FIG. 3C is a cross-sectional view of the trumpet convex curvilinear liner 300 along a line B-B in FIG. 3B. As shown in those figures and previously described with respect to FIGS. 2A-2C, the exemplary trumpet convex curvilinear liner 300 includes, among other things, a curvilinear exterior central edge 305*a*, a curvilinear interior central edge 305*b*, a curvilinear bottom edge 303 that is defined by the curvilinear interior edge 305*b*, and a first wing 304 and a second wing 304, wherein each of the first wing 304 and the second wing 304 includes a curvilinear exterior surface 354 that extends from the curvilinear exterior central edge 305*a* to an exterior peripheral edge 306 and a curvilinear interior surface 364 that extends from the curvilinear interior central edge 305*b* to an interior peripheral edge 308. A face surface 307 spans between the exterior peripheral edge 306 and the interior peripheral edge 308. Further, each of the first wing 304 and the second wing 304 has a varying thickness $t_1$, $t_2$ and the first wing 304 and the second wing 304 converge toward an apex 305 of the curvilinear exterior central edge 305*a*.

The curvilinear bottom edge 303 of the exemplary trumpet convex curvilinear liner 300 defines a bottom edge contour 310 of the trumpet convex curvilinear liner 300. The bottom edge contour 310 is convex with respect to the line or plane i that includes a first end 303*a* of the curvilinear bottom edge 303 and a second end 303*b* of the curvilinear bottom edge 303—i.e., an apex 303*c* of the bottom edge contour 310 is below the line i that includes the first end 303*a* and the second end 303*b* of the curvilinear bottom edge 303. Thus, the arc represented by the bottom edge contour 310 extends in a downward direction from each boundary at the first end 303*a* and the second end 303*b* of the curvilinear bottom edge 303 to the apex 303*c*.

With continuing reference to the trumpet convex curvilinear liner 300 shown in FIGS. 3A-3C, the curvilinear exterior central edge 305*a* defines a central edge contour 320. The central edge contour 320 is substantially arc-shaped and may be defined by, or span between, the convergence of the curvilinear exterior surface 354 of the first wing 304 and the curvilinear exterior surface 354 of the second wing 304 at the apex 305 of the curvilinear exterior central edge 305*a*.

As previously discussed with respect to the exemplary embodiment shown in FIGS. 2A-2C, the curvilinear exterior surface 354 and the curvilinear interior surface 364 of each of the first wing 304 and the second wing 304 in the exemplary trumpet convex curvilinear liner 300 shown in FIGS. 3A-3C are concave with respect to the corresponding line or plane c that includes the apex 305 of the curvilinear exterior central edge 305*a* and respectively the exterior peripheral edge 306 and interior peripheral edge 308.

Continuing with reference to FIGS. 3A-3C, the exterior peripheral edge 306 and the interior peripheral edge 308 define a face surface contour 340. The face surface contour 340 may extend between a first end 307*a* of the face surface 307 and a second end 307*b* of the face surface 307. In the exemplary trumpet convex curvilinear liner 300 shown in FIGS. 3A-3C, the face surface contour 340 is convex with respect to the line or plane e that includes each of the first end 307*a* of the face surface 307 and the second end 307*b* of the face surface 307; that is, an apex 307*c* of, e.g., the exterior peripheral edge 306 is below the line e.

Figure 4B:
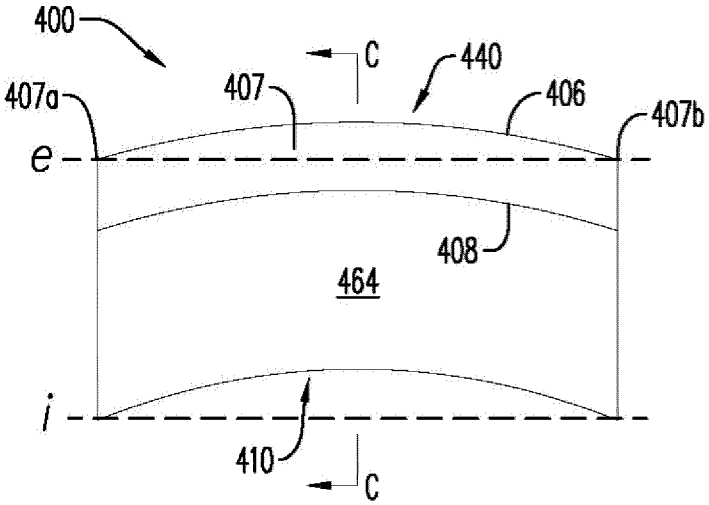
FIG. 4B shows a side plan view of the exemplary tulip concave contoured liner.
Figure 4A:
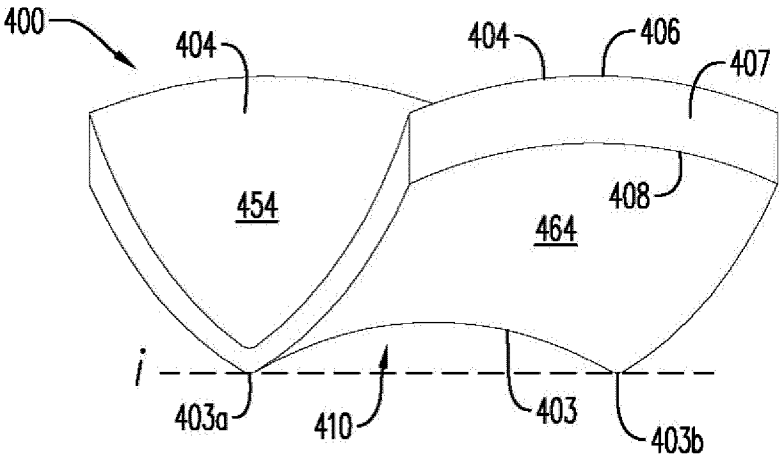
FIG. 4A shows a side perspective view of an exemplary tulip concave contoured liner.
Figure 4C:
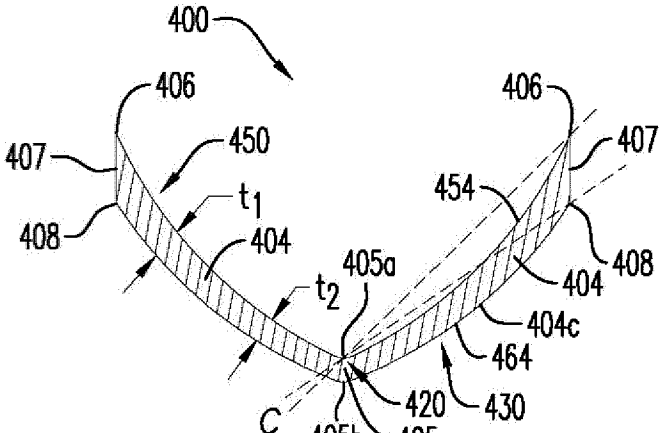
FIG. 4C shows a cross-sectional view of the exemplary tulip concave contoured liner along a line C-C in FIG. 4B.

With reference now to FIGS. 4A-4C, an exemplary embodiment of a "tulip concave" curvilinear liner 400 is shown. The "tulip" designation is indicative of the profile shown, for example, in FIG. 4C, wherein an edge contour 450 of a first wing 404 and a second wing 404 arcs vertically or inward, resembling the profile of a tulip flower. FIG. 4A shows the tulip concave curvilinear liner 400 from a side perspective view. FIG. 4B is a side plan view of the tulip concave curvilinear liner 400 and FIG. 4C is a cross-sectional view of the tulip concave curvilinear liner 400 along a line C-C in FIG. 4B. As shown in those figures and previously described with respect to FIGS. 2A-2C, the exemplary tulip concave curvilinear liner 400 includes, among other things, a curvilinear exterior central edge 405*a*, a curvilinear interior central edge 405*b*, a curvilinear bottom edge 403 that is defined by the curvilinear interior edge 405*b*, and the first wing 404 and the second wing 404, wherein each of the first wing 404 and the second wing 404 includes a curvilinear exterior surface 454 that extends from the curvilinear exterior central edge 405*a* to an exterior peripheral edge 406 and a curvilinear interior surface 464 that extends from the curvilinear interior central edge 405*b* to an interior peripheral edge 408. A face surface 407 spans between the exterior peripheral edge 406 and the interior peripheral edge 408. Further, each of the first wing 404 and the second wing 404 has a varying thickness $t_1$, $t_2$ and the first wing 404 and the second wing 404 converge toward an apex 405 of the curvilinear exterior central edge 405*a*.

The curvilinear bottom edge 403 of the exemplary tulip concave curvilinear liner 400 defines a bottom edge contour 410 of the tulip concave curvilinear liner 400. As previously discussed with respect to the exemplary embodiment shown in FIGS. 2A-2C, the bottom edge 403 is concave with respect to the line i that includes a first end 403*a* of the curvilinear bottom edge 403 and a second end 403*b* of the curvilinear bottom edge 403.

With continuing reference to the tulip concave curvilinear liner 400 shown in FIGS. 4A-4C, the curvilinear exterior central edge 405*a* defines a central edge contour 420. The central edge contour 420 is substantially arc-shaped and may be defined by, or span between, the convergence of the curvilinear exterior surface 454 of the first wing 404 and the curvilinear exterior surface 454 of the second wing 404 at the apex 405 of the curvilinear exterior central edge 405*a*.

In addition, the curvilinear exterior surface 454 and/or the curvilinear interior surface 464 of each of the first wing 404 and the second wing 404 may define a wing contour 430 of the tulip concave curvilinear liner 400 shown in FIGS. 4A-4C. For example, the curvilinear exterior surface 454 and the curvilinear interior surface 464 are convex with respect to the corresponding line or plane c that includes the apex 405 of the curvilinear exterior central edge 405*a* and respectively the exterior peripheral edge 406 and the interior peripheral edge 408. In other words, an apex 404*c* of, e.g., the curvilinear interior surface 464 is below a line c that includes the apex 405 of the curvilinear exterior central edge 405*a* and the interior peripheral edge 408.

Continuing with reference to FIGS. 4A-4C, the exterior peripheral edge 406 and the interior peripheral edge 408 define a face surface contour 440. The face surface contour 440 may extend between a first end 407*a* of the face surface 407 and a second end 407*b* of the face surface 407. As previously discussed with respect to the exemplary embodiment shown in FIGS. 2A-2C, the exterior peripheral edge 406 and the interior peripheral edge 408 are concave with respect to the line e that includes each of the first end 407*a* of the face surface 407 and the second end 407*b* of the face surface 407.

Figure 5B:
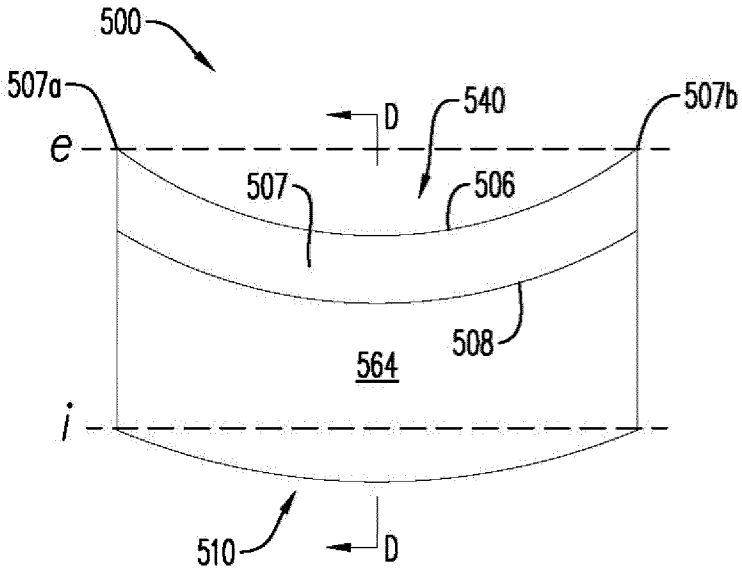
FIG. 5B shows a side plan view of the exemplary tulip convex contoured liner.
Figure 5A:
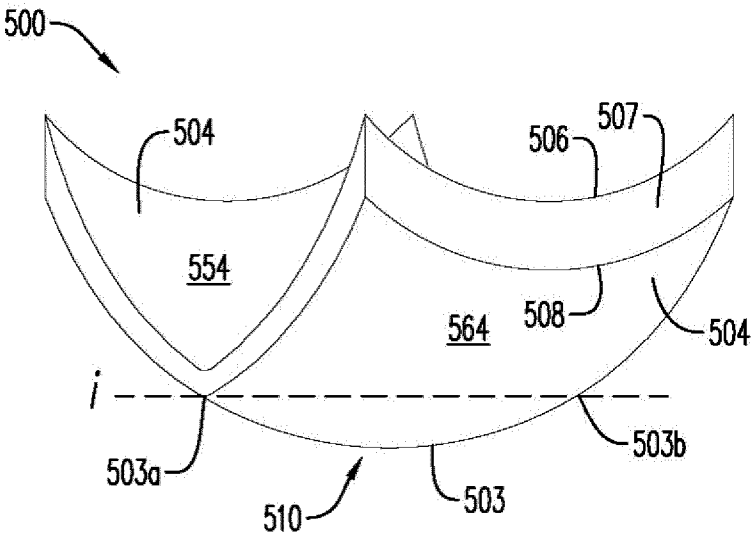
FIG. 5A shows a side perspective view of an exemplary tulip convex contoured liner.
Figure 5C:
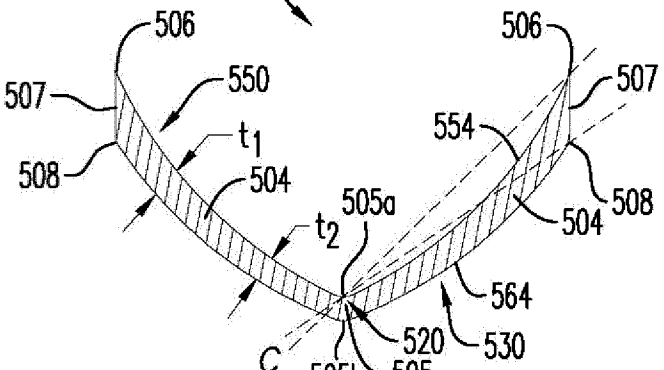
FIG. 5C shows a cross-sectional view of the exemplary tulip convex contoured liner along a line D-D in FIG. 5B.

With reference now to FIGS. 5A-5C, an exemplary embodiment of a "tulip convex" curvilinear liner 500 is shown. FIG. 5A shows the tulip convex curvilinear liner 500 from a side perspective view. FIG. 5B is a side plan view of the tulip convex curvilinear liner 500 and FIG. 5C is a cross-sectional view of the tulip convex curvilinear liner 500 along a line D-D in FIG. 5B. As shown in those figures and previously described with respect to FIGS. 2A-2C, the exemplary tulip convex curvilinear liner 500 includes, among other things, a curvilinear exterior central edge 505*a*, a curvilinear interior central edge 505*b*, a curvilinear bottom edge 503 that is defined by the curvilinear interior edge 505*b*, and a first wing 504 and a second wing 504, wherein each of the first wing 504 and the second wing 504 includes a curvilinear exterior surface 554 that extends from the curvilinear exterior central edge 505*a* to an exterior peripheral edge 506 and a curvilinear interior surface 564 that extends from the curvilinear interior central edge 505*b* to an interior peripheral edge 508. A face surface 507 spans between the exterior peripheral edge 506 and the interior peripheral edge 508. Further, each of the first wing 504 and the second wing 504 has a varying thickness $t_1$, $t_2$ and the first wing 504 and the second wing 504 converge toward an apex 505 of the curvilinear exterior central edge 505*a*.

The curvilinear bottom edge 503 of the exemplary tulip convex curvilinear liner 500 defines a bottom edge contour 510 of the tulip convex curvilinear liner 500. As previously discussed with respect to the exemplary embodiment shown in FIGS. 3A-3C, the bottom edge 503 is convex with respect to the line i that includes a first end 503*a* of the curvilinear bottom edge 503 and a second end 503*b* of the curvilinear bottom edge 503.

With continuing reference to the tulip convex curvilinear liner 500 shown in FIGS. 5A-5C, the curvilinear exterior central edge 505*a* defines a central edge contour 520. The central edge contour 520 is substantially arc-shaped and may be defined by, or span between, the convergence of the curvilinear exterior surface 554 of the first wing 504 and the curvilinear exterior surface 554 of the second wing 504 at the apex 505 of the curvilinear exterior central edge 505*a*.

In addition, the curvilinear exterior surface 554 and/or the curvilinear interior surface 564 of each of the first wing 504 and the second wing 504 may define a wing contour 530 of the tulip convex curvilinear liner 500 shown in FIGS. 5A-5C. For example, and as previously discussed with respect to the exemplary embodiment shown in FIGS. 4A-4C, the curvilinear exterior surface 554 and the curvilinear interior surface 564 are convex with respect to the corresponding line or plane c that includes the apex 505 of the curvilinear exterior central edge 505*a* and respectively the exterior peripheral edge 506 and the interior peripheral edge 508.

Continuing with reference to FIGS. 5A-5C, the exterior peripheral edge 506 and the interior peripheral edge 508 define a face surface contour 540. The face surface contour 540 may extend between a first end 507*a* of the face surface 507 and a second end 507*b* of the face surface 507. As previously discussed with respect to the exemplary embodiment shown in FIGS. 3A-3C, the exterior peripheral edge 506 and the interior peripheral edge 508 are convex with respect to the line e that includes each of the first end 507*a* of the face surface 507 and the second end 507*b* of the face surface 507.

Figure 6B:
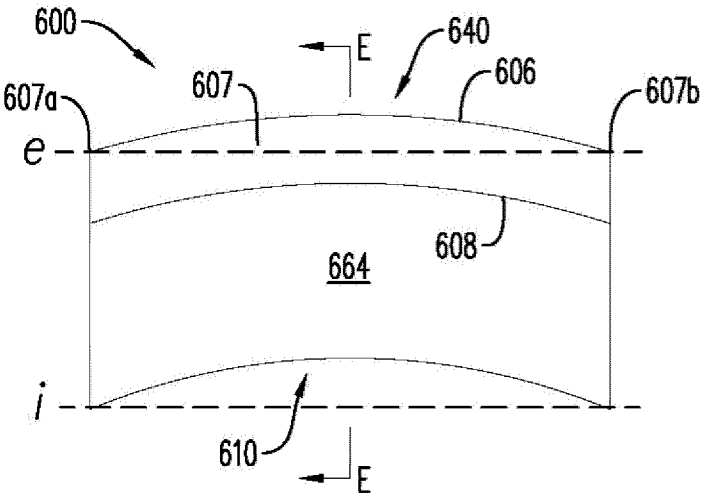
FIG. 6B shows a side plan view of the exemplary V-shape concave contoured liner.
Figure 6A:
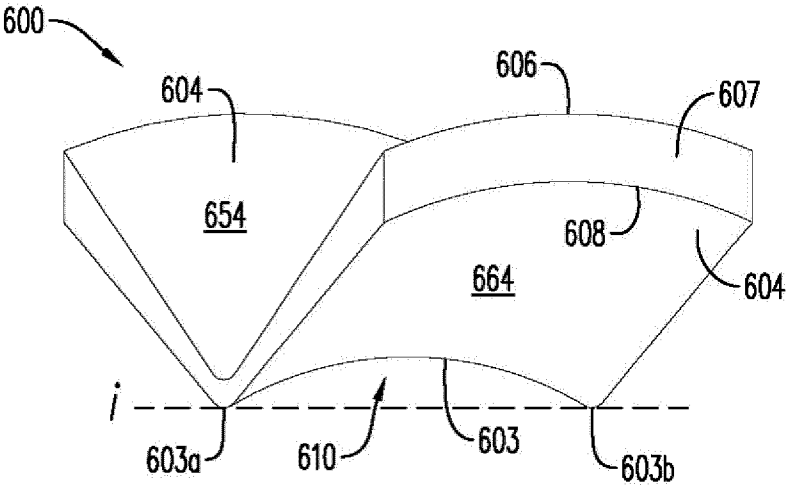
FIG. 6A shows a side perspective view of an exemplary V-shape concave contoured liner.
Figure 6C:
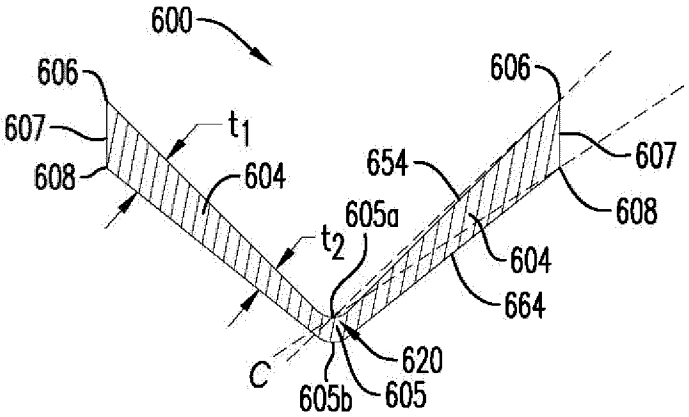
FIG. 6C shows a cross-sectional view of the exemplary V-shape concave contoured liner along a line E-E in FIG. 6B.

With reference now to FIGS. 6A-6C, an exemplary embodiment of a "V-shape concave" curvilinear liner 600 is shown. FIG. 6A shows the V-shape concave curvilinear liner 600 from a side perspective view. FIG. 6B is a side plan view of the V-shape concave curvilinear liner 600 and FIG. 6C is a cross-sectional view of the V-shape concave curvilinear liner 600 along a line E-E in FIG. 6B. As shown in those figures and previously described with respect to FIGS. 2A-2C, the exemplary V-shape concave curvilinear liner 600 includes, among other things, a curvilinear exterior central edge 605*a*, a curvilinear interior central edge 605*b*, a curvilinear bottom edge 603 that is defined by the curvilinear interior edge 605*b*, and a first wing 604 and a second wing 604, wherein each of the first wing 604 and the second wing 604 includes an exterior surface 654 that extends from the curvilinear exterior central edge 605*a* to an exterior peripheral edge 606 and an interior surface 664 that extends from the curvilinear interior central edge 605*b* to an interior peripheral edge 608. However, as shown in FIG. 6C, the cross-sections of each of the exterior surface 654 and the interior surface 664 of each of the first wing 604 and the second wing 604 is substantially straight, extending in one direction in the exemplary V-shape concave curvilinear liner 600. A face surface 607 spans between the exterior peripheral edge 606 and the interior peripheral edge 608. Further, each of the first wing 604 and the second wing 604 has a varying thickness $t_1$, $t_2$ and the first wing 604 and the second wing 604 converge toward an apex 605 of the curvilinear exterior central edge 605*a*.

The curvilinear bottom edge 603 of the exemplary V-shape concave curvilinear liner 600 defines a bottom edge contour 610 of the V-shape concave curvilinear liner 600. As previously discussed with respect to the exemplary embodiments shown in FIGS. 2A-2C and 4A-4C, the bottom edge 603 is concave with respect to the line i that includes a first end 603*a* of the curvilinear bottom edge 603 and a second end 603*b* of the curvilinear bottom edge 603.

With continuing reference to the V-shape concave curvilinear liner 600 shown in FIGS. 6A-6C, the curvilinear exterior central edge 605*a* defines a central edge contour 620. The central edge contour 620 is substantially arc-shaped and may be defined by, or span between, the convergence of the exterior surface 654 of the first wing 604 and the exterior surface 654 of the second wing 604 at the apex 605 of the curvilinear exterior central edge 605*a*. The cross-sections FIG. 6C of the exterior surface 654 and the interior surface 664 are neither concave nor convex with respect to a line or plane c that includes the apex 605 of the exterior central edge 605*a* and respectively the exterior peripheral edge 606 and the interior peripheral edge 608.

Further, the exterior peripheral edge 606 and the interior peripheral edge 608 define a face surface contour 640. The face surface contour 640 may extend between a first end 607*a* of the face surface 607 and a second end 607*b* of the face surface 607. As previously discussed with respect to the exemplary embodiments shown in FIGS. 2A-2C and 4A-4C, the exterior peripheral edge 606 and the interior peripheral edge 608 are concave with respect to the line e that includes each of the first end 607*a* of the face surface 607 and the second end 607*b* of the face surface 607.

Figure 7B:
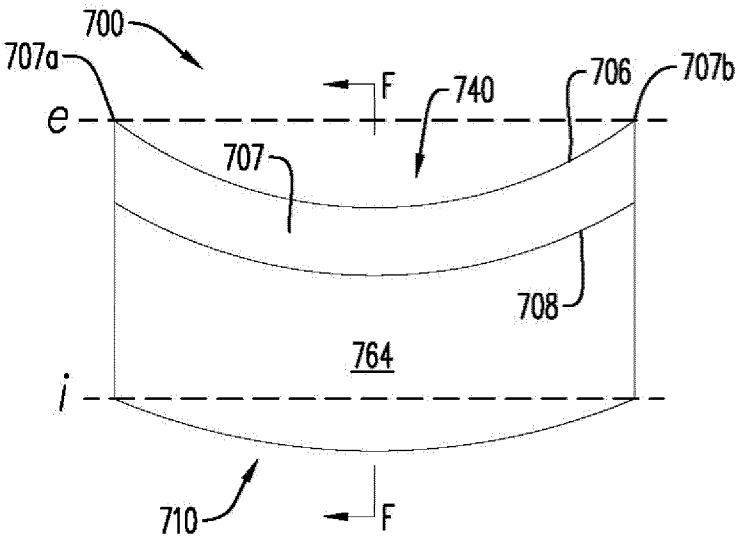
FIG. 7B shows a side plan view of the exemplary V-shape contoured liner; and, FIG. 7C shows a cross-sectional view of the exemplary V-shape contoured liner along a line F-F in FIG. 7B.
Figure 7A:
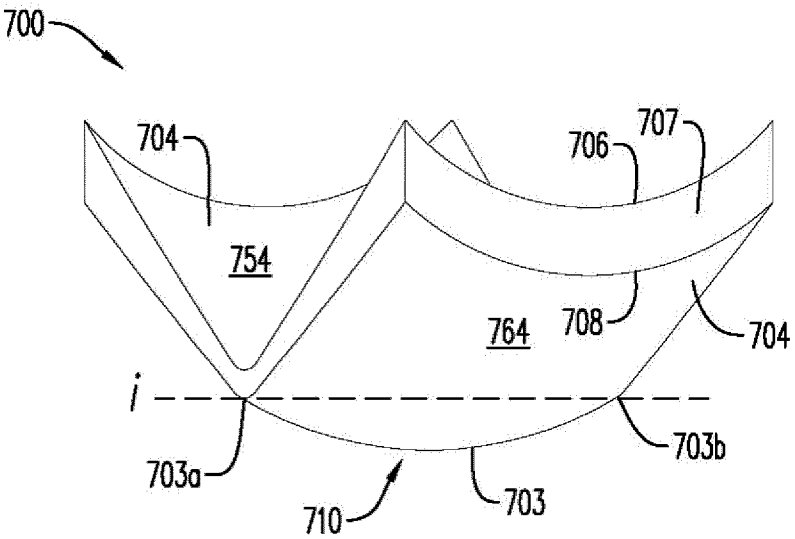
FIG. 7A shows a side perspective view of an exemplary V-shape convex contoured liner.
Figure 7C:
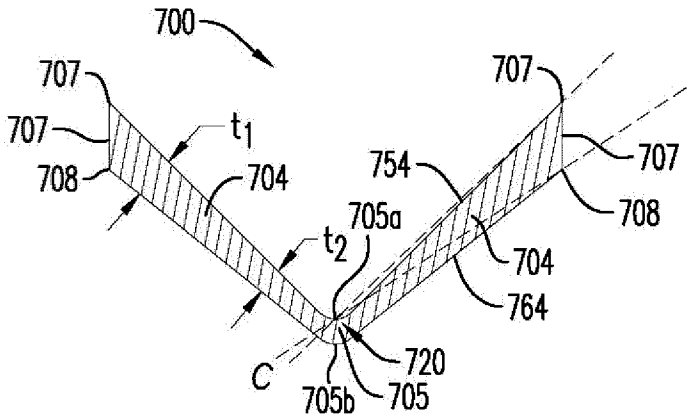

With reference now to FIGS. 7A-7C, an exemplary embodiment of a "V-shape convex" curvilinear liner 700 is shown. FIG. 7A shows the V-shape convex curvilinear liner 700 from a side perspective view. FIG. 7B is a side plan view of the V-shape convex curvilinear liner 700 and FIG. 7C is a cross-sectional view of the V-shape convex curvilinear liner 700 along a line F-F in FIG. 7B. As shown in those figures and previously described with respect to FIGS. 2A-2C, the exemplary V-shape convex curvilinear liner 700 includes, among other things, a curvilinear exterior central edge 705*a*, a curvilinear interior central edge 705*b*, a curvilinear bottom edge 703 that is defined by the curvilinear interior edge 705*b*, and a first wing 704 and a second wing 704, wherein each of the first wing 704 and the second wing 704 includes an exterior surface 754 that extends from the curvilinear exterior central edge 705*a* to an exterior peripheral edge 706 and an interior surface 764 that extends from the curvilinear interior central edge 705*b* to an interior peripheral edge 708. However, as shown in FIG. 7C, the cross-sections of the exterior surface 754 and the interior surface 764 of each of the first wing 704 and the second wing 704 is substantially straight, extending in one direction in the exemplary V-shape convex curvilinear liner 700. A face surface 707 spans between the exterior peripheral edge 706 and the interior peripheral edge 708. Further, each of the first wing 704 and the second wing 704 has a varying thickness $t_1$, $t_2$ and the first wing 704 and the second wing 704 converge toward an apex 705 of the curvilinear exterior central edge 705*a*.

The curvilinear bottom edge 703 of the exemplary V-shape convex curvilinear liner 700 defines a bottom edge contour 710 of the V-shape convex curvilinear liner 700. As previously discussed with respect to the exemplary embodiments shown in FIGS. 3A-3C and 5A-5C, the bottom edge 703 is convex with respect to the line i that includes a first end 703*a* of the curvilinear bottom edge 703 and a second end 703*b* of the curvilinear bottom edge 703.

With continuing reference to the V-shape convex curvilinear liner 700 shown in FIGS. 7A-7C, the curvilinear exterior central edge 705*a* defines a central edge contour 720. The central edge contour 720 is substantially arc-shaped and may be defined by, or span between, the convergence of the exterior surface 754 of the first wing 704 and the exterior surface 754 of the second wing 704 at the apex 705 of the curvilinear exterior central edge 705*a*. The cross-sections FIG. 7C of the exterior surface 754 and the interior surface 764 are neither concave nor convex with respect to a line or plane c that includes the apex 705 of the exterior central edge 705*a* and respectively the exterior peripheral edge 706 and the interior peripheral edge 708.

Further, the exterior peripheral edge 706 and the interior peripheral edge 708 define a face surface contour 740. The face surface contour 740 may extend between a first end 707*a* of the face surface 707 and a second end 707*b* of the face surface 707. As previously discussed with respect to the exemplary embodiments shown in FIGS. 3A-3C and 5A-5C, the exterior peripheral edge 706 and the interior peripheral edge 708 are convex with respect to the line e that includes each of the first end 707*a* of the face surface 707 and the second end 707*b* of the face surface 707.

The present disclosure, in various embodiments, configurations and aspects, includes components, methods, processes, systems and/or apparatus substantially developed as depicted and described herein, including various embodiments, sub-combinations, and subsets thereof. The present disclosure, in various embodiments, configurations and aspects, includes providing devices and processes in the absence of items not depicted and/or described herein or in various embodiments, configurations, or aspects hereof, including in the absence of such items as may have been used in previous devices or processes, e.g., for improving performance, achieving ease and/or reducing cost of implementation.

The phrases "at least one", "one or more", and "and/or" are open-ended expressions that are both conjunctive and disjunctive in operation. For example, each of the expressions "at least one of A, B and C", "at least one of A, B, or C", "one or more of A, B, and C", "one or more of A, B, or C" and "A, B, and/or C" means A alone, B alone, C alone, A and B together, A and C together, B and C together, or A, B and C together.

In this specification and the claims that follow, reference will be made to a number of terms that have the following meanings. The terms "a" (or "an") and "the" refer to one or more of that entity, thereby including plural referents unless the context clearly dictates otherwise. As such, the terms "a" (or "an"), "one or more" and "at least one" can be used interchangeably herein. Furthermore, references to "one embodiment", "some embodiments", "an embodiment" and the like are not intended to be interpreted as excluding the existence of additional embodiments that also incorporate the recited features. Approximating language, as used herein throughout the specification and claims, may be applied to modify any quantitative representation that could permissibly vary without resulting in a change in the basic function to which it is related. Accordingly, a value modified by a term such as "about" is not to be limited to the precise value specified. In some instances, the approximating language may correspond to the precision of an instrument for measuring the value. Terms such as "first," "second," "upper," "lower" etc. are used to identify one element from another, and unless otherwise specified are not meant to refer to a particular order or number of elements.

As used herein, the terms "may" and "may be" indicate a possibility of an occurrence within a set of circumstances; a possession of a specified property, characteristic or function; and/or qualify another verb by expressing one or more of an ability, capability, or possibility associated with the qualified verb. Accordingly, usage of "may" and "may be" indicates that a modified term is apparently appropriate, capable, or suitable for an indicated capacity, function, or usage, while taking into account that in some circumstances the modified term may sometimes not be appropriate, capable, or suitable. For example, in some circumstances an event or capacity can be expected, while in other circumstances the event or capacity cannot occur—this distinction is captured by the terms "may" and "may be."

As used in the claims, the word "comprises" and its grammatical variants logically also subtend and include phrases of varying and differing extent such as for example, but not limited thereto, "consisting essentially of" and "consisting of." Where necessary, ranges have been supplied, and those ranges are inclusive of all sub-ranges therebetween. It is to be expected that variations in these ranges will suggest themselves to a practitioner having ordinary skill in the art and, where not already dedicated to the public, the appended claims should cover those variations.

The terms "determine", "calculate" and "compute," and variations thereof, as used herein, are used interchangeably and include any type of methodology, process, mathematical operation or technique.

The foregoing discussion of the present disclosure has been presented for purposes of illustration and description. The foregoing is not intended to limit the present disclosure to the form or forms disclosed herein. In the foregoing Detailed Description for example, various features of the present disclosure are grouped together in one or more embodiments, configurations, or aspects for the purpose of streamlining the disclosure. The features of the embodiments, configurations, or aspects of the present disclosure may be combined in alternate embodiments, configurations, or aspects other than those discussed above. This method of disclosure is not to be interpreted as reflecting an intention that the present disclosure requires more features than are expressly recited in each claim. Rather, as the following claims reflect, the claimed features lie in less than all features of a single foregoing disclosed embodiment, configuration, or aspect. Thus, the following claims are hereby incorporated into this Detailed Description, with each claim standing on its own as a separate embodiment of the present disclosure.

Advances in science and technology may make alternatives and substitutions possible that are not now contemplated by reason of the imprecision of language; these variations should be covered by the appended claims.

What is claimed is:

1. A contoured liner for a shaped charge, comprising:

a first wing and a second wing, wherein each of the first wing and the second wing includes an exterior surface that extends from a curvilinear exterior central edge to a curvilinear exterior peripheral edge, each of the first wing and the second wing includes an interior surface that extends from a curvilinear interior central edge to a curvilinear interior peripheral edge, the first wing and the second wing converge at an apex of the curvilinear exterior central edge, and the interior surface is separated from the exterior surface by a thickness t;

a face surface including a first end and a second end that extends away from and is opposite the first end, wherein the face surface spans between the exterior peripheral edge and the interior peripheral edge; and a curvilinear bottom edge including a first end and a second end that extends away from and is opposite of the first end, wherein the curvilinear bottom edge is defined by the curvilinear interior central edge;

wherein at least one of the exterior peripheral edge and the interior peripheral edge of at least one of the first wing and the second wing is concave or convex with respect to a line or plane that includes the corresponding first end of the face surface and the second end of the fact surface.

2. The contoured liner of claim 1, wherein a cross section of the exterior surface of each of the first wing and the second wing is substantially straight, extending in one direction.

3. The contoured liner of claim 1, wherein the curvilinear bottom edge is concave with respect to a line or plane that includes the first end of the curvilinear bottom edge and the second end of the curvilinear bottom edge.

4. The contoured liner of claim 1, wherein the curvilinear bottom edge is convex with respect to a line or plane that includes the first end of the curvilinear bottom edge and the second end of the curvilinear bottom edge.

5. The contoured liner of claim 1, wherein at least one of the exterior peripheral edge and the interior peripheral edge of at least one of the first wing and the second wing is concave with respect to a line or plane that includes the corresponding first end of the face surface and the second end of the face surface.

6. The contoured liner of claim 1, wherein at least one of the exterior peripheral edge and the interior peripheral edge of at least one of the first wing and the second wing is convex with respect to a line or plane that includes the corresponding first end of the face surface and the second end of the face surface.

7. The contoured liner of claim 1, wherein the exterior surface of each of the first wing and the second wing is curvilinear.

8. The contoured liner of claim 7, wherein the exterior surface of each of the first wing and the second wing is concave with respect to a line or plane that includes the apex of the curvilinear exterior central edge and the corresponding face surface.

9. The contoured liner of claim 7, wherein the exterior surface of each of the first wing and the second wing is convex with respect to a line or plane that includes the apex of the curvilinear exterior central edge and the corresponding face surface.

10. The contoured liner of claim 1, wherein the thickness t varies along a length of at least one of the first wing and the second wing.

11. The contoured liner of claim 1, wherein the thickness t is substantially constant along a length of at least one of the first wing and the second wing.

12. The contoured liner of claim 1, wherein the first wing and the second wing are symmetrical about the curvilinear exterior central edge.

13. The contoured liner of claim 1, wherein the contoured liner is formed from one or more of copper, bronze, lead, aluminum, nickel, titanium, molybdenum, tantalum, graphite, tungsten, glass, cement, high-density composite, or plastic.

14. The contoured liner of claim 1, wherein the contoured liner is formed from at least one of a solid metal sheet, a compressed powdered metal, and a compressed powered metal alloy.

15. A shaped charge, comprising:

a shaped charge casing;

a contoured liner within the shaped charge casing; and an explosive load between the contoured liner and the shaped charge casing, wherein the contoured liner includes a first wing and a second wing, wherein each of the first wing and the second wing includes an exterior surface that extends from a curvilinear exterior central edge to a curvilinear exterior peripheral edge, each of the first wing and the second wing includes an interior surface that extends from a curvilinear interior central edge to a curvilinear interior peripheral edge, the first wing and the second wing converge at an apex of the curvilinear exterior central edge, and the interior surface is separated from the exterior surface by a thickness t, wherein the contoured liner further includes a face surface including a first end and a second end that extends away from and is opposite the first end, wherein the face surface spans between the exterior peripheral edge and the interior peripheral edge, and the contoured liner further includes a curvilinear bottom edge including a first end and a second end that extends away from and is opposite of the first end, wherein the curvilinear bottom edge is defined by the curvilinear interior central edge;

wherein at least one of the exterior peripheral edge and the interior peripheral edge of at least one of the first wing and the second wing is concave or convex with respect to a line or plan that includes the corresponding first end of the face surface and the second end of the face surface.

16. The shaped charge of claim 15, wherein the exterior surface of at least one of the first wing and the second wing is curvilinear.

17. The shaped charge of claim 16, wherein the first wing and the second wing are symmetrical about the curvilinear exterior central edge.

18. A contoured liner for a shaped charge, comprising:

a first wing and a second wing, wherein each of the first wing and the second wing includes an exterior surface that extends from a curvilinear exterior central edge to a curvilinear exterior peripheral edge, each of the first wing and the second wing includes an interior surface that extends from a curvilinear interior central edge to a curvilinear interior peripheral edge, the first wing and the second wing converge at an apex of the curvilinear exterior central edge, and the interior surface is separated from the exterior surface by a thickness t;

a face surface including a first end and a second end that extends away from and is opposite the first end, wherein the face surface spans between the exterior peripheral edge and the interior peripheral edge; and, a curvilinear bottom edge including a first end and a second end that extends away from and is opposite of the first end, wherein the curvilinear bottom edge is defined by the curvilinear interior central edge;

wherein:

the exterior surface of each of the first wing and the second wing is curvilinear; and the exterior surface of each of the first wing and the second wing is concave or convex with respect to a line or plane that includes the apex of the curvilinear exterior central edge and the corresponding face surface.

19. The contoured liner of claim 18, wherein the exterior surface of each of the first wing and the second wing is concave with respect to a line or plane that includes the apex of the curvilinear exterior central edge and the corresponding face surface.

20. The contoured liner of claim 18, wherein the exterior surface of each of the first wing and the second wing is convex with respect to a line or plane that includes the apex of the curvilinear exterior central edge and the corresponding face surface.

* * * * *